US008157709B2

(12) United States Patent
Wilkinson et al.

(10) Patent No.: US 8,157,709 B2
(45) Date of Patent: Apr. 17, 2012

(54) UNIVERSAL MULTIDIRECTIONAL EXERCISER FOR EXERCISING HAND, WRIST AND FOREARM IN MULTIPLE PLANES OF MOTION WITH ADJUSTABLE RESISTANCE

(75) Inventors: William T. Wilkinson, Media, PA (US); Juan Fernandez, Towaco, NJ (US)

(73) Assignee: William T. Wilkinson, Media, PA (US)

( * ) Notice: Subject to any disclaimer, the term of this patent is extended or adjusted under 35 U.S.C. 154(b) by 0 days.

(21) Appl. No.: 12/425,909

(22) Filed: Apr. 17, 2009

(65) Prior Publication Data

US 2010/0267523 A1 Oct. 21, 2010

(51) Int. Cl.
*A63B 23/14* (2006.01)
*A63B 21/015* (2006.01)
*A63B 21/072* (2006.01)

(52) U.S. Cl. ..... 482/45; 482/108; 482/115

(58) Field of Classification Search ..... 482/45–49, 482/106–109, 121, 114, 118, 126
See application file for complete search history.

(56) References Cited

U.S. PATENT DOCUMENTS

| | | | | | |
|---|---|---|---|---|---|
| 4,838,542 | A * | 6/1989 | Wilkinson | ..... | 482/45 |
| 4,913,417 | A * | 4/1990 | Francu | ..... | 482/45 |
| 5,046,727 | A * | 9/1991 | Wilkinson et al. | ..... | 482/45 |
| D328,113 | S * | 7/1992 | Wilkinson et al. | ..... | D21/681 |
| D341,403 | S * | 11/1993 | Wilkinson et al. | ..... | D21/684 |
| 2004/0048720 | A1 * | 3/2004 | Kuo | ..... | 482/45 |

* cited by examiner

*Primary Examiner* — Allana Lewin

(74) *Attorney, Agent, or Firm* — Brian A. Gomez; Gomez Int'l Patent Office, LLC

(57) ABSTRACT

The present invention provides a multidirectional exerciser for hand, wrist and forearm comprising a handle having an axial opening through which a bolt extends. A spring means is around one end of the bolt disposed against an adjustment ring. A resistance knob is mounted on the adjustment ring. A pressure plate is mounted at the opposite end of the handle between the handle and the head of the bolt. At least one clutch disc is disposed against the pressure plate. A knob is mounted around the pressure plate and clutch disc, mounted for relative rotational movement with respect to the handle. The wrists and hands are exercised by holding the handle in one hand and the knob/grip member in the other hand, and repetitively twisting the handle and knob/grip member in opposite directions. A detachable grip member is mounted over said knob and the detachable grip member further comprises a gyro ring and a squeeze grip strengthener.

52 Claims, 8 Drawing Sheets

UNIVERSAL MULTIDIRECTIONAL EXERCISER FOR EXERCISING HAND, WRIST AND FOREARM IN MULTIPLE PLANES OF MOTION WITH ADJUSTABLE RESISTANCE

BACKGROUND OF THE INVENTION

Various types of wrist exercise devices are known in the art, generally exercising in only one plane of motion and are not adjustable. One particularly effective device is disclosed in U.S. Pat. No. 5,046,727. Other devices are disclosed in U.S. Pat. Nos. 4,838,542 and 3,856,267. These devices basically operate by holding one portion of the device in one hand and grasping a knob with the other hand. The exercise is achieved by twisting the knob or handle in the opposition to resistance against the twisting motion.

SUMMARY OF THE INVENTION

One object of the present invention is to provide an exerciser capable of exercising three major motions of the wrist including rotational movement, up and down movement and side to side movement. Another object of this invention is to provide a method and device for increasing grip and finger strength through isometric and repetitive squeezing over a full range of resistance. A further object of the invention is to provide an exerciser for lowering stress and blood pressure. With lowering of stress and blood pressure, a further object of the present invention is to aid in weight loss.

The present invention includes a sports model for improving strength, conditioning, range of motion and flexibility. The present invention also includes a medical kit designed to aid in injury prevention and rehabilitation from an injury or surgery.

A further object of this invention is an improved exercise dumbbell comprising the exerciser of the present invention and further comprising one or more weighted end caps or circular weights on at least one end of the exerciser. Thus, the improved dumbbell incorporates new wrist and grip development dimensions for a major improvement to traditional dumbbells.

Another object of this invention is to provide an improved multidirectional exerciser for hand, wrist and forearm generally of the above type wherein the resistance of the device can be easily set and readily readjusted to achieve a desired level for a workout. The level of resistance precisely adjusts continuously from zero at the low end of resistance, to complete lock up at the high end of resistance. Specifically, zero resistance is little or no resistance wherein lock up is at the point where the knob will not move during exercise. Thus, the present invention provides a complete range of resistance for all users.

Specifically, the present invention provides a multidirectional exerciser for hand, wrist and forearm that comprises a detachable or non-detachable grip member wherein the detachable squeeze grip member further comprises a gyro ring. The present invention is readily adjustable for a regular progressive exercise program for all types of people with varying hand sizes, age and physical strength. Thus, the invention is universal in nature, with one model providing a range of hand and wrist exercises, for all people. The exerciser of the present invention is equally suited for rehabilitative uses, for improving strength, flexibility and range of motion, as an injury preventative, and for work or sports training and strengthening.

In accordance with this invention the wrist exercise device includes a handle having an axial opening. In one embodiment, a bolt extends completely through the opening with a spring mounted means around one end of the bolt against an adjustment ring mounted around the bolt. A resistance adjustment knob is mounted on the bolt. The resistance offered by the spring can be readily adjusted by a twisting of the resistance adjustment knob to axially compress or relax the spring means.

A pressure plate is disposed at the opposite end of the handle between the handle and the head of the bolt. At least one clutch disc is mounted against the handle and pressure plate with a knob disposed around the handle and the pressure plate and the disc for relative rotational movement with respect to the handle. The device is operated with the user holding the handle in one hand and holding the second knob with the other hand and then twisting the handle or second knob. Thus, one wrist is moved up and down and the other wrist moved side to side at the same time.

Yet another object of this invention is a progressive exercise and hand rehabilitation program and method of exercising hand, wrist and forearm comprising the steps of:

a) turning the resistance knob of the exerciser of the present invention thereby setting the desired resistance level;

b) holding the exerciser of the present invention by placing a first hand around the handle and placing a second hand over the detachable grip member;

c) rotating the first hand/wrist up and down while simultaneously rotating the second hand/wrist side to side thereby simultaneously rotating the hands/wrists in different direction;

d) turning the exercise device 180 degrees and placing the first hand over the detachable grip member and placing the second hand around the handle; and e) rotating the first hand up and down while simultaneously rotating the second hand side to side thereby simultaneously rotating the hands in opposite directions;

f) rotating wrists in a circular motion with the gyro; and g) repetitive squeezing of grips of various strength and sizes.

In a preferred practice of the invention a resistance adjustment knob is mounted to the bolt and is seated in the adjustment ring. The adjustment knob includes indicia on its exposed face to provide an indication of the level of resistance which would be utilized in the use of the device and would also be used to determine the direction to the turn the knob to get lower/higher resistance. The spring can preferably be in the form of a Bellville washer. Preferably two clutch discs are provided with each disc being on a separate side of an inward extension of a knob.

DETAILED DESCRIPTION OF THE INVENTION

Figure 1B:
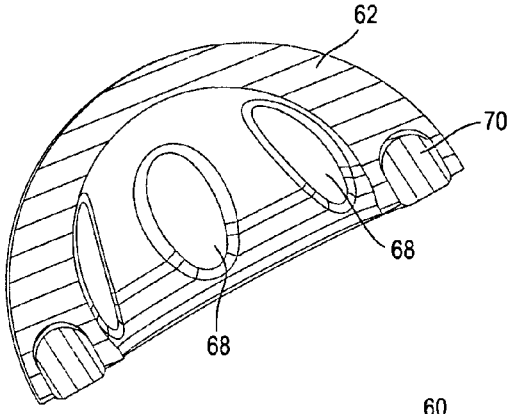
FIG. 1B is a cross sectional view of the detachable grip member.
Figure 1A:
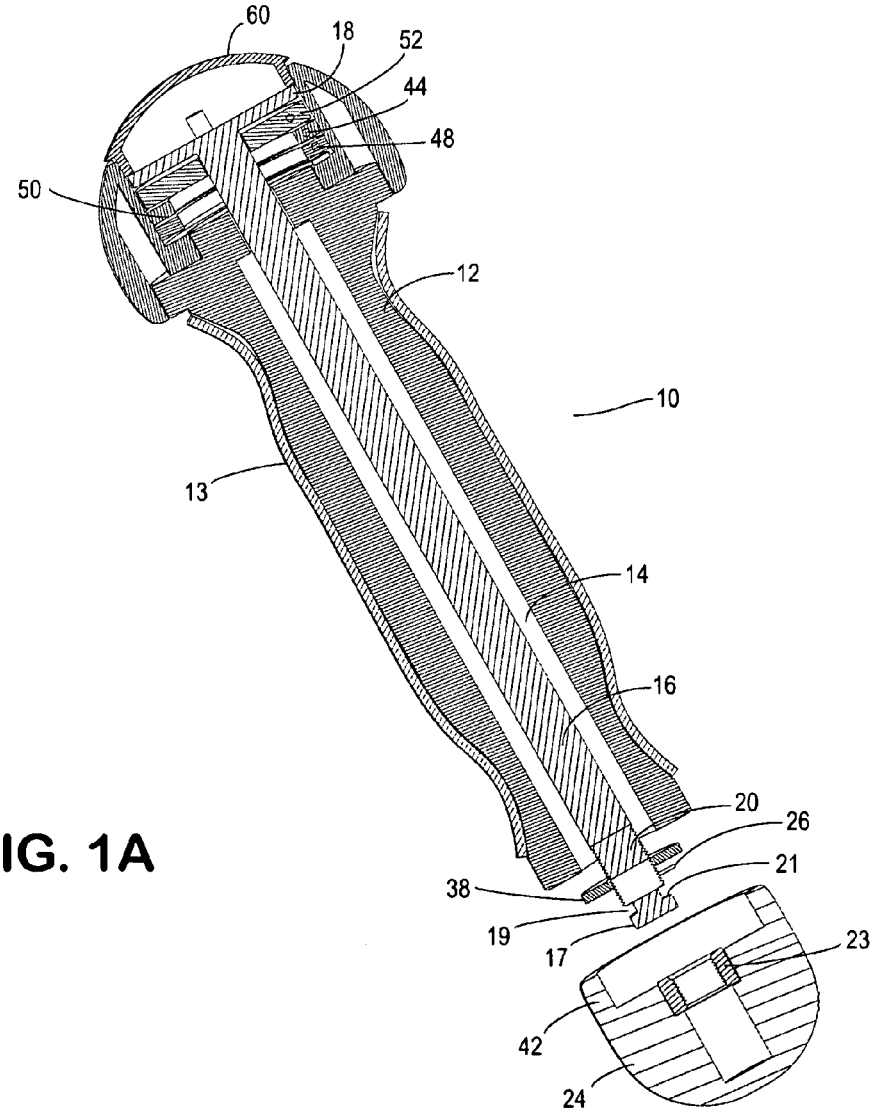
FIG. 1A is a cross sectional view of the exerciser of the present invention.

The present invention relates to a wrist exercise device which operates along the general principles of U.S. Pat. Nos. 5,046,727; 4,838,542 and 3,856,267, the details of which are incorporated herein by reference thereto. In general, wrist exercise device 10 comprises a handle 12 which has an outer surface 13, such as neoprene or rubber, to facilitate gripping by the user. Several variations of grips can be used as desired with raised bumps or ribs. As best shown in FIG. 1A handle 12 includes an axial opening 14 extending completely therethrough. A bolt 16 is mounted through the axial opening. The bolt 16 is predominantly thread-free with the exception of a threaded portion at the first end. Bolt 16 is threaded at the first end 20 and has an enlarged head 18 at its second end. The threaded section of the bolt does not extend to the end of the bolt. Instead, the end of the bolt 17 is thread-free. In addition, there is a cutout 21 in the thread-free end of the bolt 16 wherein the bolt diameter is reduced. A retaining clip made of metal, plastic or other suitable material can be secured in the reduced diameter section as a further attachment means. The bolt end 17 of the bolt 16 is thread-free with a diameter similar the entire length of the bolt 16.

Figure 2:
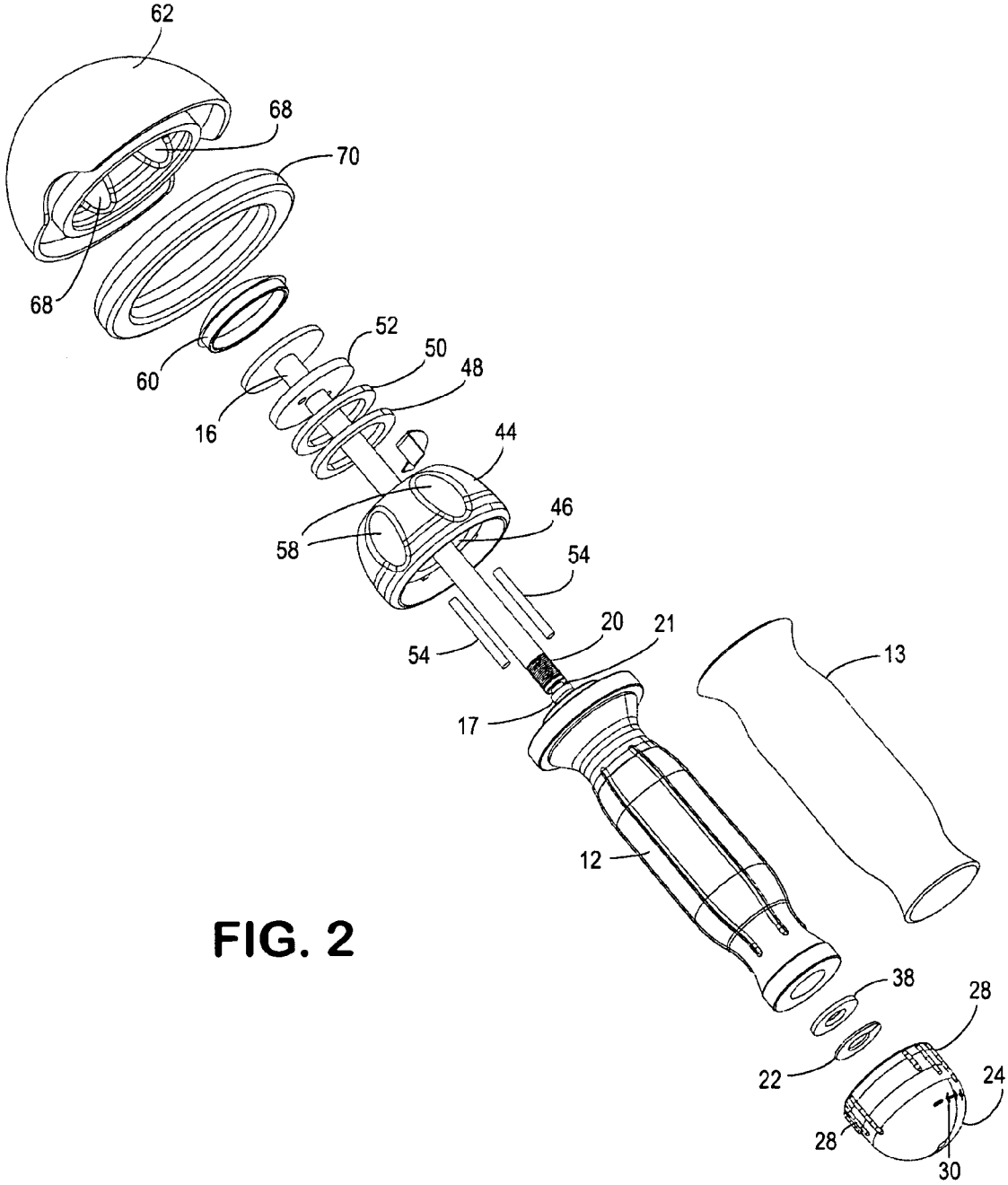
FIG. 2 is an exploded view of the exerciser of the present invention.

As best shown in FIG. 1A and FIG. 2, spring means, which can be in the form of a standard washer or optionally with a lock washer 38, or in the form of a Bellville washer, is mounted around threaded end 20 of bolt 16. Washer 38 can function as a compression spring which applies tension to the bolt as later described. An adjustment knob 24 is fixedly secured to a metal nut 23. The adjustment knob 24 and nut 23 are mounted in threaded engagement with threaded end 20 and handle 12. A pin 26 is disposed through a hole 19 in the lower portion of bolt 16 between the washer 38 and end of bolt 17. The pin 26 helps secure the adjustment knob 24 to the bolt 16 so that once assembled, the nut 23 is secured to the bolt 16 and the adjustment knob 24 cannot be removed. When adjustment knob 24 is rotated clockwise it compresses washer 22 (FIG. 2 only) for increasing the resistance as described later. Conversely counterclockwise rotation decreases the resistance by permitting washer 22 to relax. Adjustment knob 24 fits into and around the nut 23 and bolt end 17, cutout 21 and threaded end 20 of bolt 16.

As shown in FIG. 2 the adjustment knob 24 is provided with one or more indicators 28 and/or an arrow 30. Indicator arrow 30 is disposed along indicia 28 on the outer surface of adjustment knob 24. By the fixed threaded engagement of adjustment knob 24 with bolt end 20 the resistance would change in accordance with the rotation of adjustment knob 24 relative to handle 12 and bolt 16.

As also shown in FIG. 1A and FIG. 2 a flat washer 38, such as a ⅜ inch washer is mounted against handle 12 between the end of handle 12 and pin 26 and the peripheral extension 42 formed in adjustment knob 24. The peripheral extension 42 of adjustment knob 24 is dimensioned to fit around the tapered surface at the end of handle 12 and conceal pin 26 and washer 38. Flat washer 38 functions as a metal bearing surface for spring washer 22 to protect plastic handle 12 as shown in FIG. 2.

Figure 3:
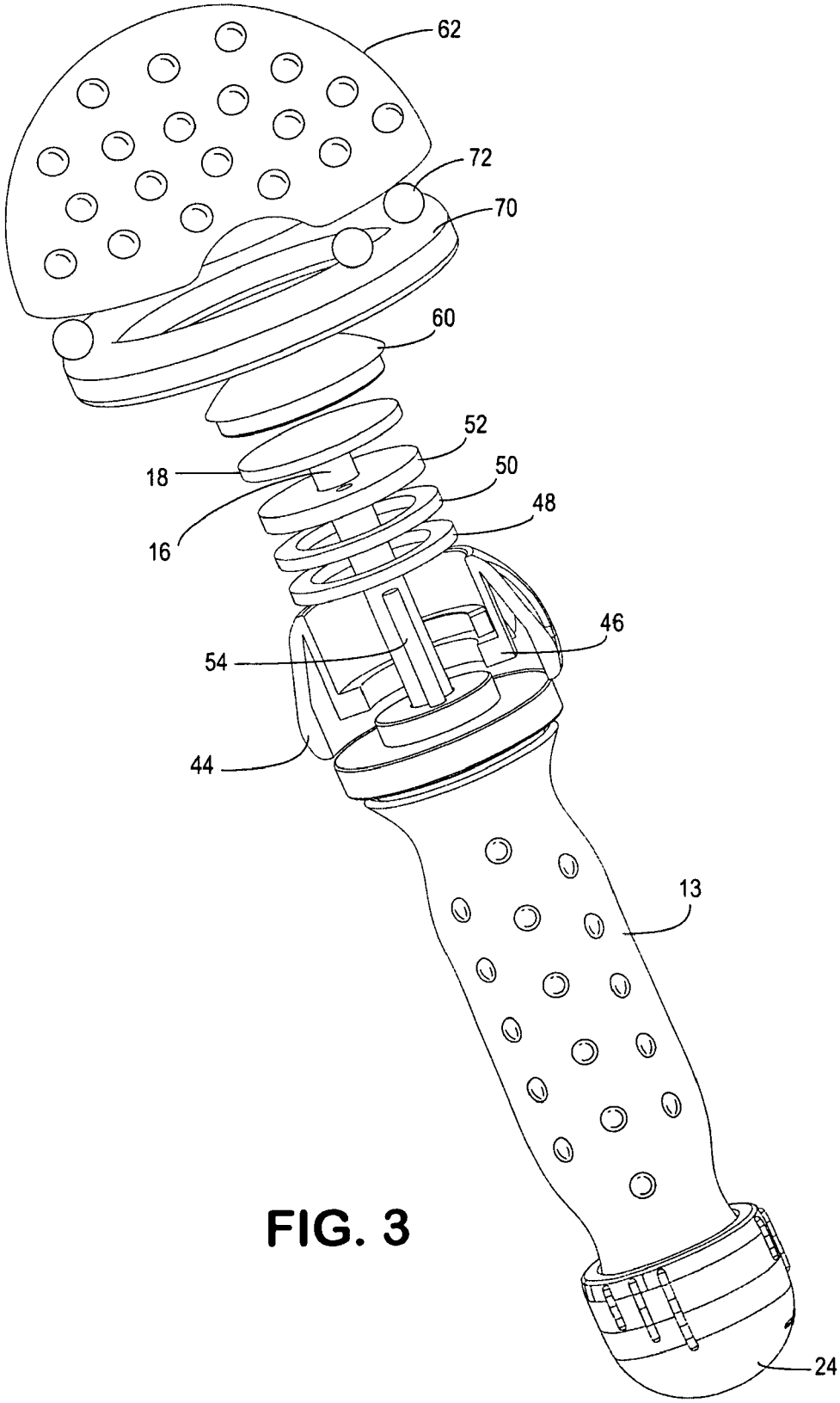
FIG. 3 is a partially exploded view of the exerciser with a preferred handle and detachable grip member.

As also illustrated in FIG. 1A, FIG. 2 and FIG. 3, a second knob 44 is provided at the opposite end of handle 12 for relative rotation with respect to handle 12. Second knob 44 includes an annular inward extension 46 with a clutch disc 48 and 50 mounted on top of the extension 46. Outer clutch disc 50 is disposed against pressure plate 52 which is sandwiched between enlarged head 18 of bolt 16 and the end wall of handle 12. At least one pin 54 extends through plate 52 and into handle 12 to prevent any relative rotation of pressure plate 52 with respect to handle 12. Thus, although bolt 16 extends through an opening 53 in plate 52 there is no relative rotation between plate 52 and bolt 16 or handle 12. Once assembled, a retainer clip 76 secures the second knob to the handle 12 so that the second knob 44 cannot be removed.

As illustrated a plurality of gripping elements 58 are provided on the outer surface of second knob 44 to facilitate the user gripping and rotating second knob 44. The gripping elements may be protrusions or depressions. As later described the gripping elements engage complementary structure 68 on the inner surface of detachable grip member 62 (FIG. 1B and FIG. 2) to prevent slipping of the detachable grip member.

Seated within the detachable grip member 62 is a gyro ring 70. Weighted balls 72 are contained within the ring 70. FIG. 3 shows the balls 72 on top of the ring 70 for illustration purposes, however, the balls 72 are contained within the gyro ring 70. The gyro ring 70 can be removeable from the detachable grip member 62. The gyro ring 70 can be used with the detachable grip member or independently by holding the ring 70 in one hand and rotating the hand.

As illustrated, second knob 44 is of generally annular shape having an open outer end to facilitate the assembly of the various components. The open end is then closed by a knob cap 60 which not only conceals unsightly parts, such as bolt head 18, but also provides a surface on which, for example, advertising logo can be placed.

In practice, resistance adjustment knob 24 is secured to the end of bolt 16 by any securing means and can be glued, secured with a retaining clip, or molded around the nut. When adjustment right 24 is rotated clockwise it compresses washer 22. Washer 22 reacts against handle 12 to increase the pressure on clutch discs 48 and 50 thereby increasing the force required to turn or rotate knob 44 with respect to handle 12. Since adjustment knob 24 has indicia 28 and 30 on its outer face the user can readily determine the direction to turn adjustment knob 24 and the compression of washer 22 for increasing or decreasing the resistance. Extension 46 of knob 44, like plate 52, acts as an abutment member for its clutch disc.

As indicated, in one embodiment, washer 22 acts as a compression spring which applies tension to the bolt 16 forcing the clutch discs 48, 50 against the knob 44 and pressure plate 52 and handle 12. The handle 12 can be held stationary with one hand and the knob 44 is turned with the other hand. Alternatively handle 12 can be turned while knob 44 is held stationary producing the restraining forces required for exercising the wrists.

The clutch discs 48 and 50 provide the necessary friction and wear surfaces as the handle and knob are rotated with respect to each other. Pressure plate 52 functions to transfer the spring force on the head 18 of bolt 16 to the clutch discs 48, 50. Thus, the bolt 16 provides a means of adjusting the tension on the washer 22. Extension 46 of knob 44, like plate 52, acts as an abutment member for its clutch disc.

Flat washer 38 functions to prevent washer 22 from damaging the plastic handle 12. Pin 54 functions to restrain the pressure plate 52 from turning with respect to handle 12 thereby providing four clutch bearing surfaces.

In initial operation the user would set up wrist exercise device 10 to its zero adjustment. This would be accomplished by turning adjustment knob 24 so that there is minimum force required to turn the knob 44 with respect to handle 12. While holding the adjustment knob 24 and handle 12 together, the adjustment knob 24 would then be tightened, increasing resistance and thereby conditioning device 10 for initial use.

In further operation when it is desired to increase the force for turning the knob 44 and handle 12 with respect to each other, adjustment knob 24 would be rotated so that the level of resistance is increased or decreased as desired. Several obvious variations showing resistance level can be used including an increasing series of vertical lines.

A further feature of this invention is the provision of a larger detachable grip member 62, to accommodate different hand sizes. Grip member 62 is designed to push on and pull off the knob 44. The detachable grip member 62 can be changed depending upon the users physical characteristics, thus providing a smaller or larger and softer or harder hand hold for more comfort to accommodate larger and smaller hand size. In this respect, grip member 62 would be made of a softer material than knob 44. To facilitate the gripping of grip member 62 its outer surface can be textured. Interchangeable grips provided by grip member 62 provides the flexibility of customizing the knob with varying size and varying durometer for different squeeze resistance in accordance with the size and strength of the hands of the individual user.

The resistance of the detachable grip member 62 can be further adjusted by the placement of a squeeze insert, or squeeze ball, in the cavity in the grip member. By placing squeeze inserts of varying durometer in the grip member cavity, the resistance of the grip member 62 can be increased and varied depending upon the resistance desired.

As illustrated, grip member 62 includes a plurality of mounting members 68 which fit in depressions 58 of knob 44 so as to firmly hold grip member 62 on knob 44 without any relative rotation therebetween.

In the preferred practice of the invention handle 12, adjustment knob 24, and second knob 44 are all made of suitable plastic materials. Bolt 16, nut 23, washer 22, washer 38 and plate 52 as well as pin 54 are preferably made of metal materials. Although FIG. 3 illustrates only one pin 54 a plurality of pins (as shown in FIG. 2) can be used for mounting plate 52 to handle 12. If desired, head 18 can include enlarged extensions having openings through which the pins 54 may extend.

The invention may be practiced with certain variations. For example, instead of having a Bellville washer mounted against an internally threaded insert which engages the externally threaded end 20 of bolt 16, it is possible to use other compression spring means. It is also possible to simply mount the Bellville washer or other types of spring over the exposed end of member 16. In this variation member 16 need not be a bolt but could be a rod or shaft having a smooth unthreaded end 20. Thus member 16 can be broadly considered as a shaft which functions to provide a means of adjusting tension. When the shaft is provided with threads at one end and a head at the other end the shaft may be a bolt as illustrated. Otherwise any other suitable structure may be used in accordance with the remaining components with which the shaft interacts. Where shaft or member 16 is not a bolt, adjustment knob 24 would be mounted on shaft 16 for longitudinal movement on the shaft to control the amount of compression of the spring.

Several additional modifications to the exerciser can be included depending upon the desires of the end user. For example, the exerciser can also incorporate a vibration mechanism in the detachable grip member, the handle or the second knob 44. A flashlight mechanism can also be incorporated into the device. As the exerciser uses repetitions for strengthening and increasing flexibility and range of motion, a repetition counter or meter can be incorporated into the device. For ease of measurement, an audible tone or click can signal a completed repetition.

Figure 4A:
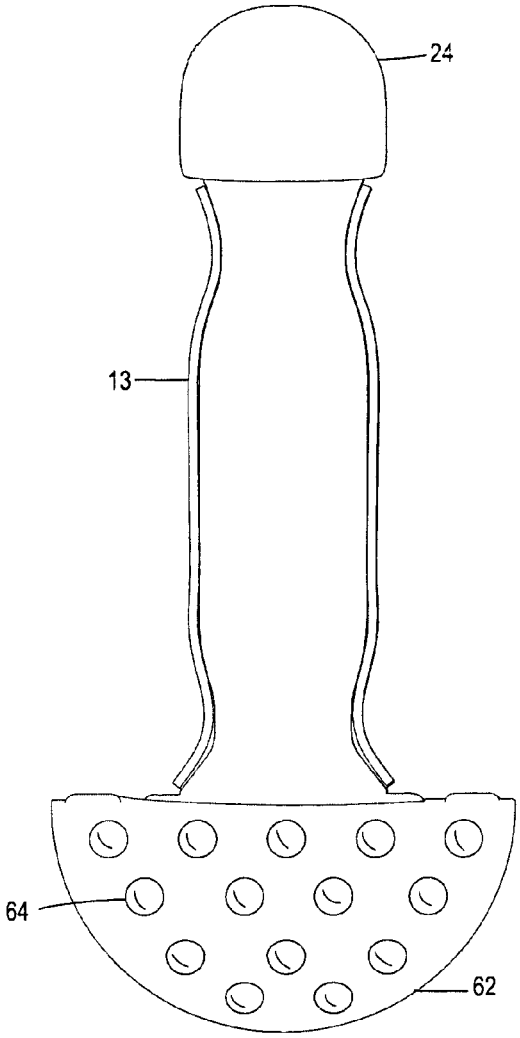
FIG. 4A is a side view of the exerciser.
Figure 4B:
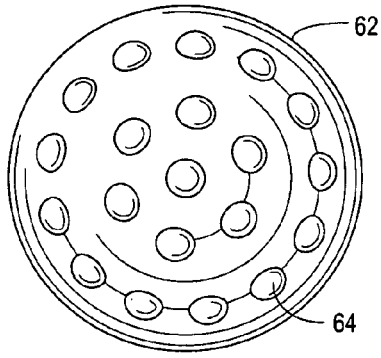
FIG. 4B is a top view of the detachable grip member.
Figure 4D:
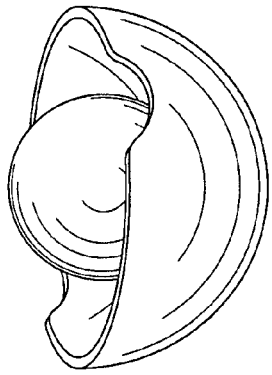
FIG. 4D illustrates a squeeze ball after insertion into the cavity of the detachable grip member.
Figure 4C:
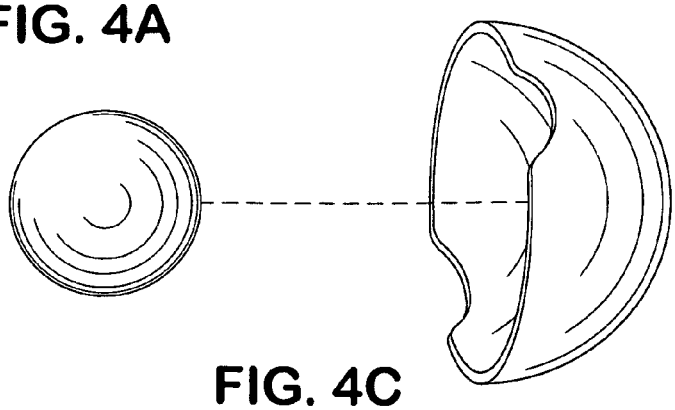
FIG. 4C illustrates a squeeze ball before insertion into the cavity of the detachable grip member.

FIGS. 4A-4D illustrate the exerciser of the present invention and alternative uses of the detachable grip member. FIG. 4A is a side view of the exerciser with the massage grip detachable member with protrusions 64 on the surface of the member. FIG. 4B is a top view of the massage grip detachable member. FIGS. 4C and 4D illustrate an additional use of the grip member 62 with the insertion of a squeeze ball into the center cavity within the grip member 62. By inserting a squeeze ball of varying durometer, one can adjust the resistance of the grip member itself.

Figure 5:
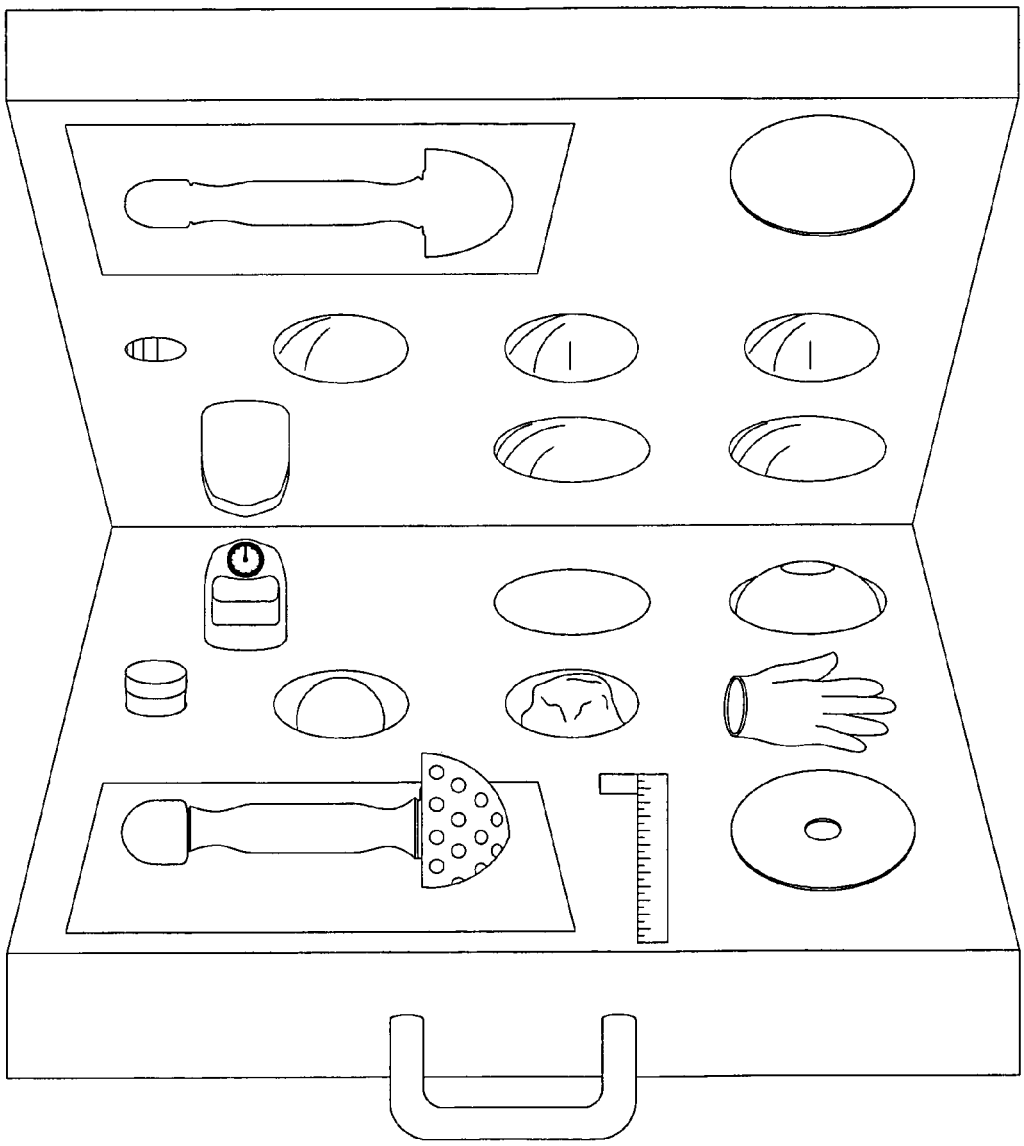
FIG. 5 is a front view of the medical kit of the present invention.

As shown in FIG. 5, the present invention can be configured as a hand, wrist and forearm medical rehabilitation kit comprising the exerciser of the present invention, one or more detachable grip members of varying size and durometer; one or more gyro rings of varying weight; one or more interchangeable grips; a grip gauge, a squeeze ball, squeeze putty, a slide caliper, a glove, a medication jar and a carrying case.

Figure 6A:
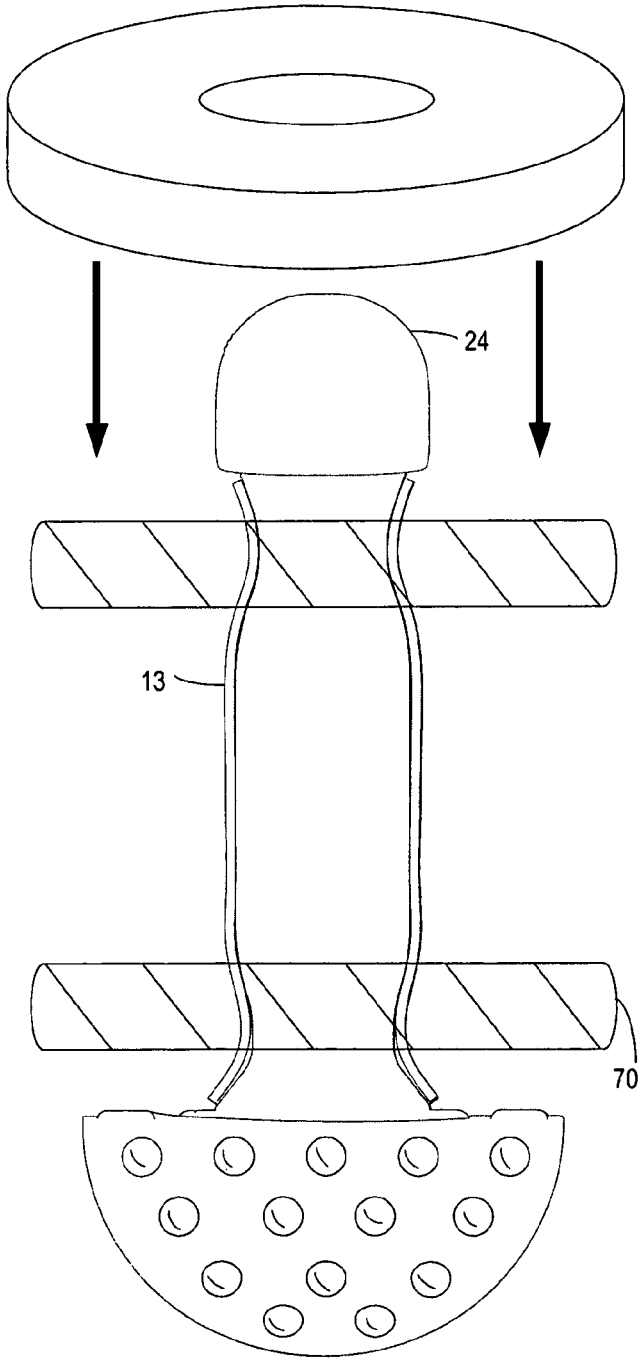
FIG. 6A is a side view of the improved dumbbell of the present invention.
Figure 6B:
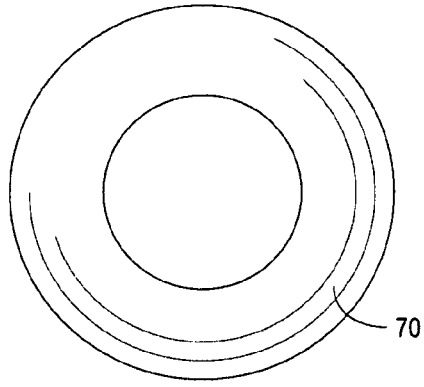
FIG. 6B is a top view of a weight of the improved dumbbell of the present invention.
Figure 7:
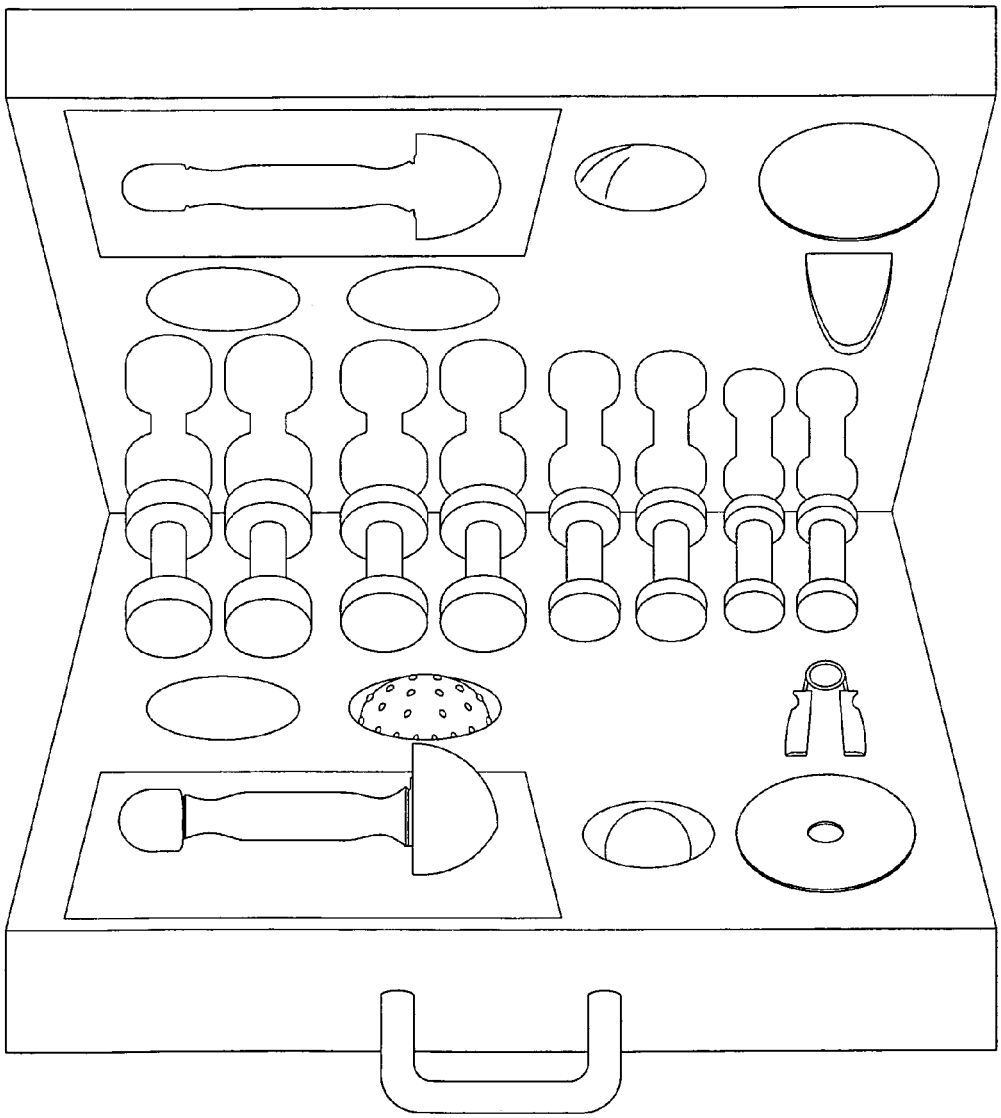
FIG. 7 is a front view of the improved dumbbell kit of the present invention.

The exerciser of the present invention also provides an improved dumbbell. The exerciser is designed and adapted to receive interchangeable weighted end caps thereby converting to a smart dumbbell. The weighted end caps can connect by any means including clip on, snap on, screw on or interference fit. FIG. 6A illustrates the weights sliding on both ends of the exerciser. FIG. 6B is a top view of an annular weight of the present invention. The exerciser of the present invention can be incorporated into a dumbbell kit which is shown in FIG. 7.

Figure 8A:
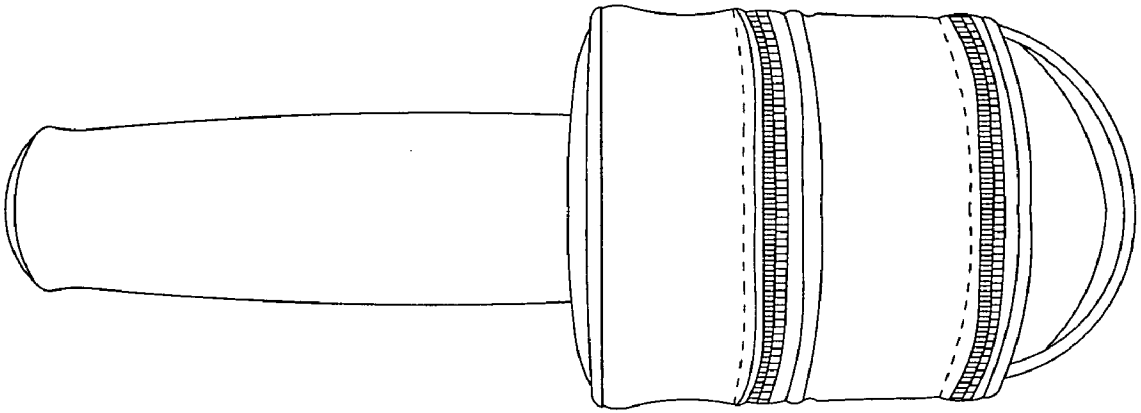
FIGS. 8A and 8B illustrate a side view and top view of the carrying case of the present invention.
Figure 8B:
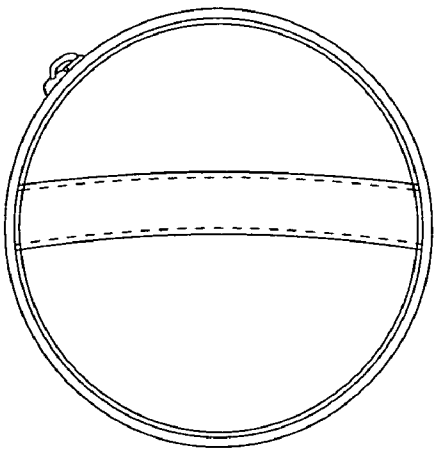

As shown in FIGS. 8A and 8B, the exerciser of the present invention can be stored and carried in a convenient case. FIG. 8A illustrates a side view of the case while FIG. 8B shows a top view of the case. The case includes a carry strap on top of the case and zippers for securing a storage compartment and the exerciser itself.

The exerciser of the present invention can also be used as a stationary universal, multidirectional exerciser for hand, wrist and forearm of claim 1 for gym or home use wherein the exerciser is incorporated into an exercise station/machine and a user is preferably seated but could be standing. For this application, a larger exerciser can be used.

Use of the universal multidirectional exerciser of the present invention can increase the users strength, conditioning, mobility, range of motion and flexibility. Use of the exerciser also can improve grip strength which can lower stress and reduce blood pressure. A further benefit of using the exerciser in reducing stress and blood pressure is that it can aid in weight loss, since stress has been associated with increased fat production.

Other variations are also possible within the concepts of this invention.

We claim:

1. A universal multidirectional, exerciser for hand, wrist and forearm comprising a handle having an axial opening extending completely therethrough, said handle having a first end and a second end, a shaft extending completely through said axial opening at said first end and said second end of said handle, spring means mounted outside of said handle around an end of said shaft at said first end of said handle, a resistance adjustment knob mounted to said shaft spaced from said first end of said handle, said spring means being mounted in the space between said handle and said adjustment knob, said adjustment knob being longitudinally mounted on said shaft and having a bearing surface which is disposed against said spring means to adjust the extent of compression of said spring means upon longitudinal movement of said adjustment knob toward and away from said handle, at least one clutch disc mounted against said handle at said second end of said handle, an abutment member mounted against said clutch disc, and a second knob mounted around said abutment member and said clutch disc and said second end of said handle in rotational relationship with respect to said handle whereby said second knob and said handle may be rotated with respect to each other against the force applied by said clutch disc which is adjusted in accordance with the compression of said spring means wherein the improvement comprises a resistance adjustment knob that enables continuously adjustable resistance and a detachable grip member mounted over said second knob wherein the detachable grip member further incorporates a gyro ring wherein the gyro ring comprises a ring containing one or more weighted balls that can move freely inside the ring.

2. The universal multidirectional exerciser of claim 1 wherein said adjustment knob is rotatably mounted to said shaft, said abutment member being a pressure plate, and said pressure plate being mounted to said second end of said handle in nonrotational relationship thereof.

3. The universal multidirectional exerciser of claim 2 wherein said adjustment knob includes a seat, a nut being mounted in said seat and secured to said shaft whereby said adjustment knob has indicia on said adjustment knob peripherally arranged with respect to said adjustment knob, and an indicator on said adjustment knob disposed toward said indicia to indicate the amount of resistance in accordance with the rotational movement with respect to said adjustment knob.

4. The universal multidirectional exerciser of claim 3 wherein said shaft is a bolt having a threaded portion located near a first end of the bolt around which said spring means is mounted and having an enlarged head at the second end of the bolt disposed against said plate wherein the bolt comprises thread-free sections on either side of the threaded portion so that the resistance adjustment knob travels along the threaded portion of the bolt but cannot detach from the bolt.

5. The universal multidirectional exerciser of claim 4 wherein said second knob includes an inward extension, one of said clutch discs being mounted on each side of said inward extension to comprise a first and a second clutch disc, said first clutch disc being disposed between said extension and said handle, said second clutch disc being disposed between said extension and said plate, and a pin extending through said plate and into said handle to prevent said plate from rotating with respect to said handle.

6. The universal multidirectional exerciser of claim 5 wherein said spring means is a Bellville washer, and said adjustment knob having an annular extension around said first end of said handle concealing said Bellville washer.

7. The universal multidirectional exerciser of claim 6 including a detachable grip member mounted over said second knob.

8. The universal multidirectional exerciser of claim 7 including a knob cap over said second knob covering said pressure plate.

9. The universal multidirectional exerciser of claim 8 wherein said handle and said grip member have textured and or cushioned outer surfaces.

10. The universal multidirectional exerciser of claim 9 wherein said second knob includes spaced depressions, and said detachable grip member includes mounting members on its inner surface for engagement with said spaced depressions.

11. The universal multidirectional exerciser of claim 6 including a flat washer between said Bellville washer and said handle, and said bearing surface of said adjustment knob being on an insert and threadedly engaged with said bolt.

12. The universal multidirectional exerciser of claim 11 wherein said bolt and said Bellville washer and said flat washer and said plate and said pin and said insert are made of metal, and said handle and said knob and said adjustment knob are made of plastic.

13. The universal multidirectional exerciser of claim 2 wherein said shaft is a bolt having a threaded end around which said spring means is mounted and having an enlarged head disposed against said plate.

14. The universal multidirectional exerciser of claim 13 wherein said second knob includes an inward extension, one of said clutch discs being mounted on each side of said inward extension to comprise a first and a second clutch disc, said first clutch disc being disposed between said extension and said handle, said second clutch disc being disposed between said extension and said plate and a pin extending through said plate and into said handle to prevent said plate from rotating with respect to said handle.

15. The universal multidirectional exerciser of claim 14 wherein said spring means is a Bellville washer, and said adjustment knob having an annular extension around said first end of said handle concealing said Bellville washer.

16. The universal multidirectional exerciser of claim 7 including a detachable grip member mounted over said second knob.

17. The universal multidirectional exerciser of claim 1 wherein the gyro ring is removeable.

18. The universal multidirectional exerciser of claim 17 wherein the gyro ring sits within the detachable grip member and attaches with an interference fit.

19. The universal multidirectional exerciser of claim 1 wherein the gyro ring is securedly fixed to the detachable grip member.

20. The universal multidirectional exerciser of claim 1 wherein the detachable grip member varies in size, durometer and or texture.

21. The universal multidirectional exerciser of claim 1 wherein the detachable grip member is constructed of hypoallergenic materials to reduce skin irritation.

22. The universal multidirectional exerciser of claim 1 further comprising a flashlight mechanism.

23. The universal multidirectional exerciser of claim 1 wherein the handle comprising a sponge grip.

24. The universal multidirectional exerciser of claim 1 for exercising both wrists in opposite directions at same time wherein one wrist moves up and down while one wrist moves side to side.

25. The universal multidirectional exerciser of claim 1 comprising a third knob, similar to the second knob, detachably or non-detachably secured to the adjustment knob for exercising both wrists in same direction at the same time.

26. The universal multidirectional exerciser of claim 1 further comprising a repetition or rotation counter.

27. The universal multidirectional exerciser of claim 1 wherein the handle or the detachable grip member comprises one or more protrusions for massaging one or both hands.

28. The universal multidirectional exerciser of claim 1 further comprising a vibrating mechanism.

29. The universal multidirectional exerciser of claim 28 wherein the vibrating mechanism is located in the detachable grip member, handle or second knob.

30. The universal multidirectional exerciser of claim 1 further comprising a carrying case for protecting and storing the exerciser.

31. The universal multidirectional exerciser of claim 30 wherein the carrying case further comprises one or more compartments.

32. The universal multidirectional exerciser of claim 30 wherein the carrying case further comprises a carry or hanger loop or handle.

33. The universal multidirectional exerciser of claim 1 further comprising a stop mechanism on the resistance adjustment knob so that the resistance knob cannot separate from the exerciser.

34. An improved exercise dumb bell comprising the universal multidirectional exerciser of claim 1 and further comprising one or more weighted end caps on at least one end of the exerciser.

35. The exercise dumb bell of claim 34 wherein the weighted end caps are removeable and can vary in size, weight and shape.

36. The exercise dumb bell of claim 35 wherein the weighted end caps are secured to the exerciser by any means.

37. The exercise dumb bell of claim 34 wherein the weighted end caps are permanently secured.

38. A hand, wrist and forearm medical rehabilitation kit comprising the exerciser of claim 1, and one or more of the following: detachable grip members of varying size and durometer; one or more gyro rings of varying weight; one or more removeable end cap weights of varying weight; one or more interchangeable grips; and a carrying case.

39. The hand, wrist and forearm medical rehabilitation kit of claim 38 further comprising at least one item selected from the group consisting of; vibrating end cap, grip strength gauge, caliper, tape measure, instructional book, video or DVD, medications, hand creams, lotions, pain cream, soaps, gloves, cuticle kit, callous sander, squeeze ball, squeeze putty, hot and cold packs, mechanical or digital repetition counter, and gripping material.

40. A hand, wrist and forearm injury prevention medical kit comprising the exerciser of claim 1, and one or more of the following: detachable grip members of varying size and durometer; one or more gyro rings of varying weight; one or more removeable end cap weights of varying weight; one or more interchangeable grips; and a carrying case.

41. The universal multidirectional exerciser of claim 1 wherein the detachable grip member has a flat top so that the exerciser can stand or store upright.

42. The universal multidirectional exerciser of claim 1 wherein the detachable grip member comprises a center cavity and wherein the grip member center cavity is adapted to incorporate one or more squeezable inserts thereby increasing the resistance of the detachable grip member and wherein the squeezable inserts are sport specific.

43. The universal multidirectional exerciser of claim 42 wherein the squeezable inserts are any kind, shape, material to alter resistance level of the detachable grip member.

44. The universal multidirectional exerciser of claim 42 wherein the squeezable inserts are sport specific and is at least one selected from the group consisting of golf ball, soccer ball, bowling ball, baseball, softball, tennis ball, squash ball, basketball and football.

45. A hand, wrist and forearm work conditioning/strengthening kit comprising the exerciser of claim 1, and one or more of the following: detachable grip members of varying size and durometer; one or more gyro rings of varying weight; one or more removeable end cap weights of varying weight; one or more interchangeable grips; and a carrying case.

46. The universal multidirectional exerciser of claim 1 wherein the gyro ring is made of a non-metal material such as plastic.

47. The universal multidirectional exerciser of claim 46 wherein the non-metal gyro ring is chrome plated.

48. The universal multidirectional exerciser of claim 1 further adapted to exercise ankles and feet.

49. The universal multidirectional exerciser of claim 1 further comprising a counter or meter attachable to at least one end of the exerciser to monitor repetitions and or time.

50. The universal multidirectional exerciser of claim 49 further comprising an audible indicator to measure repetitions and degree of rotation.

51. The universal multidirectional exerciser of claim 1 further comprising one or more heating or cooling elements.

52. A stationary universal multidirectional, exerciser for hand, wrist and forearm of claim 1 for gym or home use wherein the exerciser is incorporated into an exercise machine/station and a user is preferably seated but could be standing.

* * * * *